United States Patent [19]

Okumura et al.

[11] Patent Number: 5,033,888

[45] Date of Patent: Jul. 23, 1991

[54] RIBBON GUIDE MECHANISM FOR A THERMAL PRINTER WITH A RIBBON CASSETTE

[75] Inventors: Takashi Okumura; Koshiro Yamaguchi, both of Nagoya, Japan

[73] Assignee: Brother Kogyo Kabushiki Kaisha, Japan

[21] Appl. No.: 443,026

[22] Filed: Nov. 30, 1989

Related U.S. Application Data

[63] Continuation of Ser. No. 233,557, Aug. 18, 1988, abandoned, which is a continuation of Ser. No. 27,488, Mar. 18, 1987, abandoned.

[30] Foreign Application Priority Data

Mar. 24, 1986 [JP] Japan ..... 61-66884

[51] Int. Cl.[5] ..... B41J 35/08

[52] U.S. Cl. ..... 400/248; 400/208; 400/234

[58] Field of Search ..... 400/120 HE, 208, 229, 400/248, 234

[56] References Cited

U.S. PATENT DOCUMENTS

| | | | |
|---|---|---|---|
| 4,147,439 | 9/1979 | Colecchi | 400/234 X |
| 4,387,380 | 6/1983 | Asakura et al. | 400/120 |
| 4,402,622 | 9/1983 | Sugiura | 400/234 X |
| 4,468,139 | 8/1984 | Hattori | 400/120 |

FOREIGN PATENT DOCUMENTS

| | | | |
|---|---|---|---|
| 82056 | 5/1982 | Japan | 400/208 |
| 76285 | 5/1984 | Japan | 400/229 |
| 99687 | 6/1985 | Japan | 400/208 |
| 222277 | 11/1985 | Japan | 400/208 |

OTHER PUBLICATIONS

"Ribbon Cartridge Having Self-Induced Take-Up Motion"; anonymous; *IBM Tech Disc. Bull.*; vol. 27, No. 10B, pp. 6356-6357; Mar. 1985.

*Primary Examiner*—David A. Wiecking

*Attorney, Agent, or Firm*—Kane, Dalsimer, Sullivan, Kurucz, Levy, Eisele and Richard

[57] ABSTRACT

A printer with an improved ribbon guide mechanism. A pair of ribbon guides is mounted via fixing members, one being on each of both sides of a printing head, so as to be positioned in the path of a print ribbon. Thus the ribbon guides are movable together with the printing head to an operating position and a rest position. Leaf springs are provided to press the ribbon at all times against the ribbon guides on either side of the printing head. This allows the length of a portion of the print ribbon moving through between the guides on either side of the printing head to be maintained substantially constant, whether the printing head is at its operating position or at its rest position, thereby preventing the occurrence of slackness in the ribbon.

6 Claims, 3 Drawing Sheets

RIBBON GUIDE MECHANISM FOR A THERMAL PRINTER WITH A RIBBON CASSETTE

This is a continuation of co-pending application Ser. No. 233,557 filed on Aug. 18, 1988, now abandoned, which was a continuation of Ser. No. 27,488, filed Mar. 18, 1987, now abandoned.

BACKGROUND OF THE INVENTION

This invention relates to a printer with a ribbon guide mechanism which guides the path of a print ribbon.

Generally, there is a printer which moves a printing head to a print position in the vicinity of a platen to guide, with the aid of the printing head, a portion of the ribbon exposed from a ribbon cassette to dispose the ribbon portion in the vicinity of a sheet of printing paper on the platen, prints on the sheet through the ribbon by moving the printing head, and performs a space shift and a paper feed with the printing head being placed at a release position spaced from the platen.

In this conventional printer, the ribbon is guided independent of the movement of the printing head, so that slackness may be produced in the ribbon by the movement of the printing head, which pulled the ribbon during printing, to the release position. The slackness is absorbed into the ribbon cassette using the resiliency of a spring provided within the cassette. However, in the cassette from which a large amount of ribbon appears outside, slackness in the ribbon is not sufficiently absorbed. Therefore, removal of the slackness becomes unsteady, in which case the ribbon may move zigzag out of its normal path or a jam may occur. In a printer of the type which guides and moves a ribbon with the aid of the printing head from the left end of a print line to the right end thereof to move the ribbon, the ribbon may be deviated greatly from its normal path in the vicinity of the right of the line once it is moved zigzag in the vicinity of the left end of the line, so that the printing head will not face the ribbon correctly, thereby causing defective printing.

SUMMARY OF THE INVENTION

This invention has been made to solve the above problems. The object of this invention is to provide a printer with a ribbon guide mechanism which prevents the occurrence of slackness in the ribbon in the vicinity of the printing head to ensure a stable movement of the ribbon, and prevents defective printing.

In order to achieve the above object, a printer according to this invention comprises a carriage movable along a platen; a printing head disposed on said carriage and selectively movable at a print position in the vicinity of said platen and at a release position spaced from said platen; a ribbon cassette containing a print ribbon movable between said platen and said printing head; a pair of ribbon guides disposed on said carriage so as to be positioned in the path of said print ribbon, one being selectively disposed on each of both sides of said printing head, each of said ribbon guides being selectively disposable at an operating position in the vicinity of said platen and at a rest position spaced from said platen; and means for switching the position where said ribbon guides are disposed, in accordance with the position where the printing head is disposed, so as to maintain the substantially constant length of a portion of said ribbon moving from one ribbon guide through said printing head to the other ribbon guide irrespective of the position of said ribbon guides.

In the above construction, the switching means switches the position where the ribbon guides are disposed, in accordance with the position where the printing head is disposed. At the time, the length of the portion of the ribbon moving from one ribbon guide to the other ribbon guide through the space between the printing head and the platen is maintained substantially constant independent of the position where the ribbon guide is disposed. Therefore, switching the position of the printing head will not produce any slackness in the ribbon in the vicinity of the printing head.

BRIEF DESCRIPTION OF THE DRAWINGS

FIG. 5(*b*) is also an enlarged cross-sectional view taken along the line A—A of FIG. 4 after the ribbon cassette has been mounted.

DETAILED DESCRIPTION OF THE PREFERRED EMBODIMENTS

One embodiment of this invention will now be described with reference to the drawings.

Figure 1:
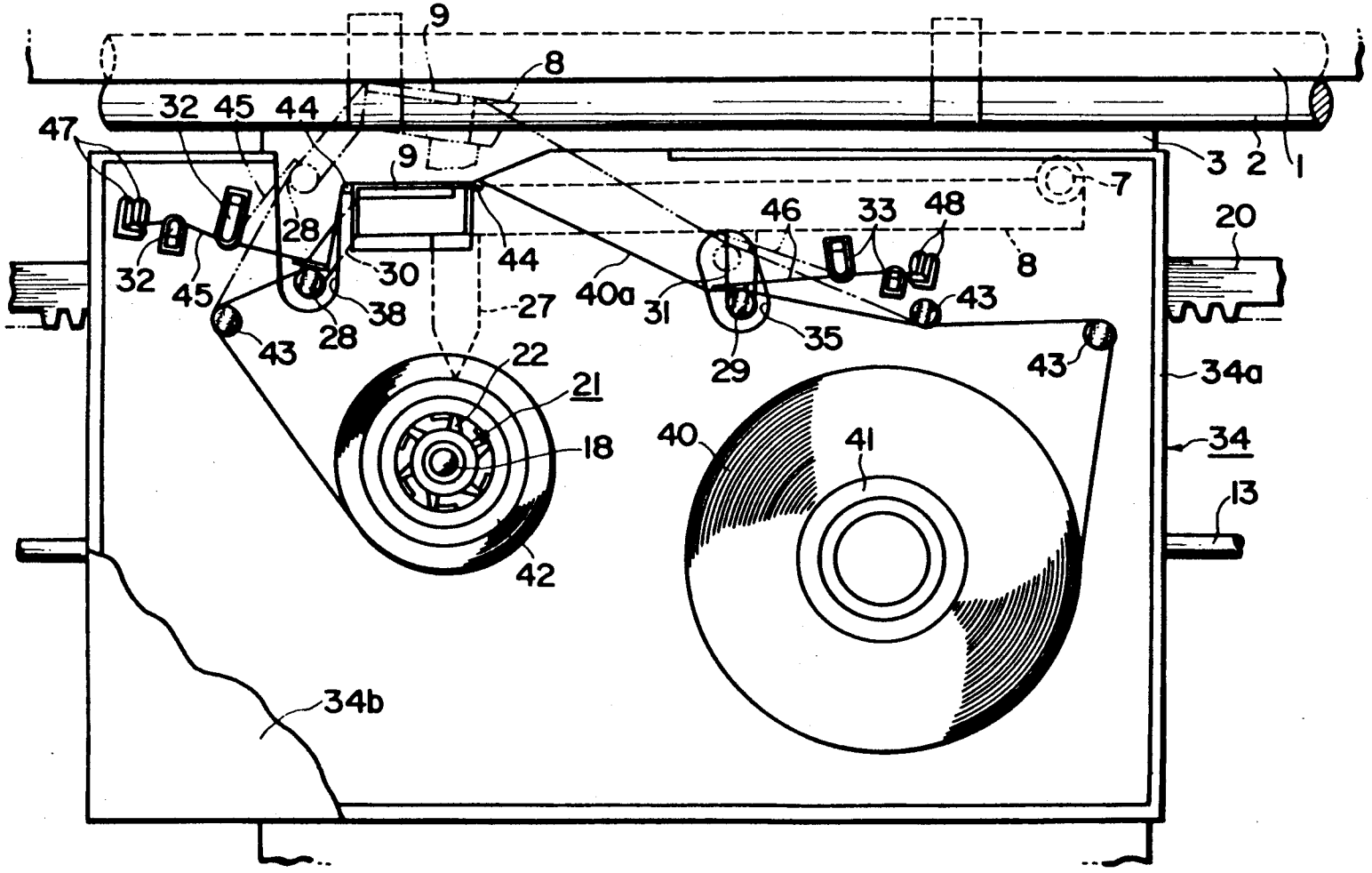
FIG. 1 is a plane view of a printer in which this invention is embodied.
Figure 2:
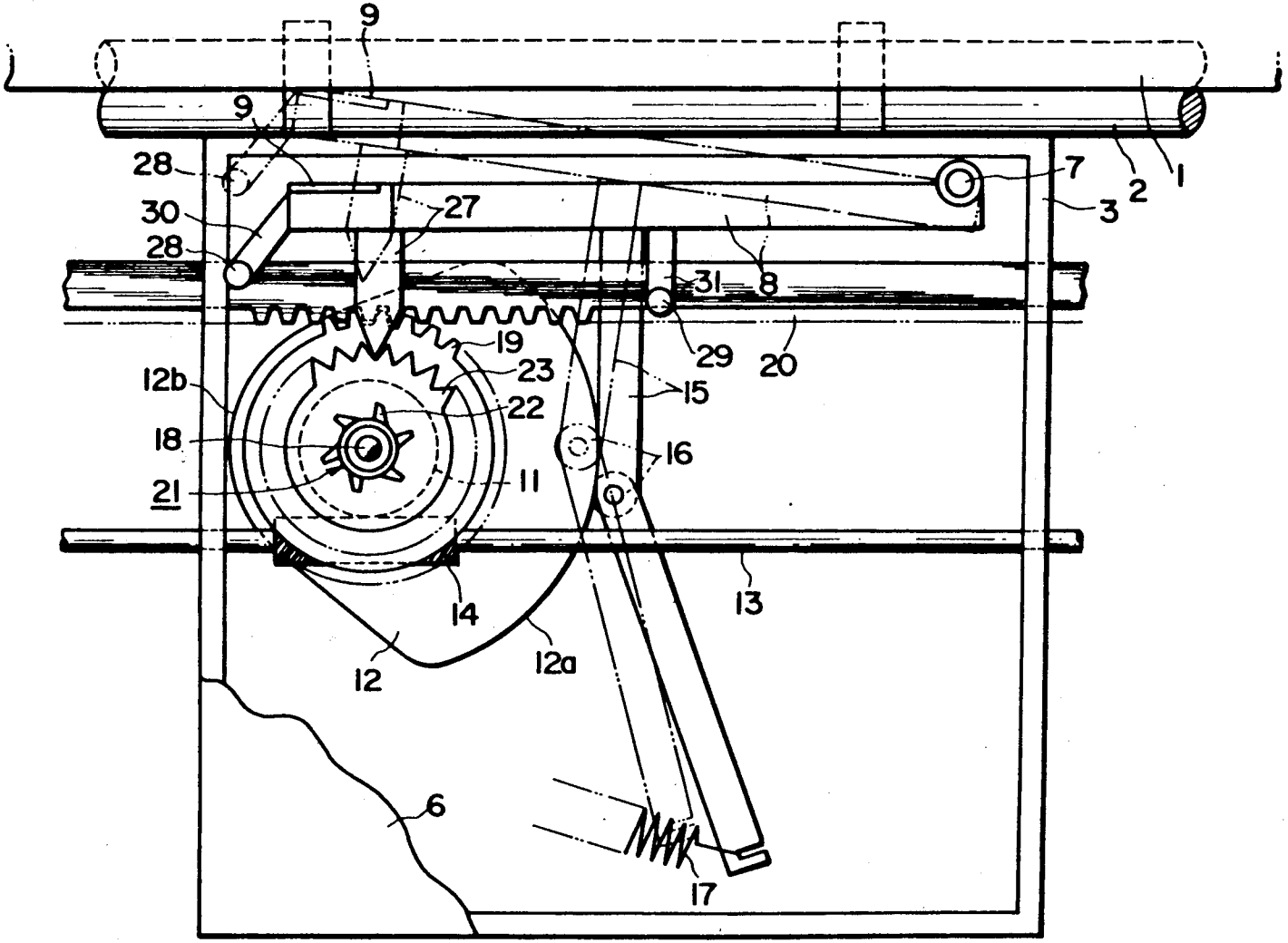
FIG. 2 is a plane view of the printer from which the ribbon cassette is removed away.

As shown in FIGS. 1 and 2, a horizontally extending platen 1 is disposed over a frame (not shown) of a printer of this embodiment. A guide rod 2 is disposed below and parallel to the platen. A carriage 3 is supported movable along platen 1 with a cassette holder 6, shown in FIG. 3, being mounted on the upper surface of carriage 3.

Figure 3:
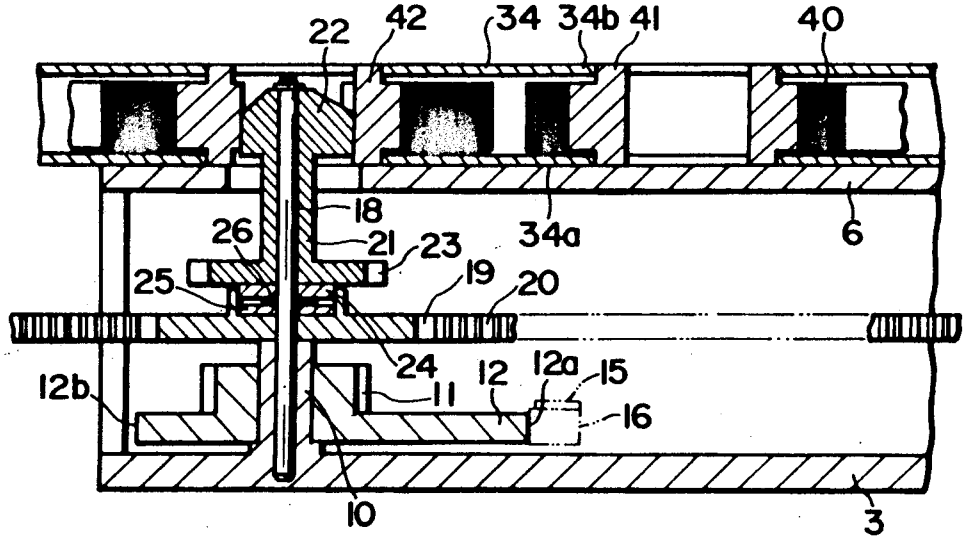
FIG. 3 is a cross-sectional view of the printer.

As shown in FIG. 2, a support arm 8 is supported rotatably by a support shaft 7 on the backward portion of carriage 3 with a printing head 9 consisting of a thermal head being provided at the free end of the arm 8. As shown in FIG. 3, a boss 10 is provided which protrudes from the upper left-hand surface of carriage 3. Rotatably supported on boss 10 is a release cam 12 having a helical gear 11 formed integrally therewith. A drive shaft 13, extending right and left through carriage 3, is supported rotatably within the frame. A worm 14 is fitted over drive shaft 13 so as to rotate as a unit with the drive shaft and movable as a unit with carriage 3. When drive shaft 13 is rotated, release cam 12 is rotated by the engagement of worm 14 with helical gear 11.

A cam follower 16, engageable with release cam 12, is provided on the middle portion of a support lever 15 protruding from support arm 8. A spring 17 is provided at the free end of support lever 15 to bias cam follower 16 into engagement with release cam 12, namely, to press printing head 9 against platen 1. In the state where cam follower 16 is engaged with a larger diameter portion 12*a* of release cam 12, printing head 9 on support arm 8 is disposed at a release position spaced from platen 2, as shown in FIGS. 1 and 2. When cam follower 16 is placed opposed to a smaller diameter portion 12*b* of the cam 12 as same rotates, release cam 12 is disengaged from cam follower 16 and printing head 9 is disposed at print position where the printing head abuts agaist platen 2, as shown by the dot-dot-dashed line in FIGS. 1 and 2.

A rack 20, extending right and left through carriage 3, is provided on the frame. A pinion 19 is supported rotatably on a support shaft 18 provided at the center of boss 10 so that the pinion is rotated through its engagement with rack 20 by the movement of carriage 3. A take-up member 21 is supported rotatably on support shaft 18 above pinion 19. A spool engagement member 22, extending upwardly through cassette holder 6, is formed at the upper end of the take-up member. A meshing member 23, having teeth around its periphery, is formed integrally with the take-up member 21 at the lower end of same. A permanent magnet 24 and an opposing magnetic member 25, for example, of an iron plate, are firmly secured to the lower central surface of the take-up member 21 and the upper central surface of pinion 19, respectively, so as to be rotatable together, with a spacer 26 of a nonmagnetic material being inserted between magnet 24 and magnetic member 23.

Support arm 8 has at its end a pawl 27 engageable with the teeth of meshing gear 23. When printing head 9 is disposed at the release position shown by the solid line in FIG. 2, pawl 27 is engaged with meshing member 23 to stop the rotation of take-up member 21. When under this condition the pinion 19 is rotated, a slippage is produced between permanent magnet 24 on take-up member 21 and magnetic member 25 on pinion 19. On the other hand, when printing head 9 is disposed at the printing position shown by the dot-dot-dashed line in the same Figure, pawl 27 is disengaged from meshing member 23. When under this condition the pinion 19 is rotated, the magnetic force of magnet 24 exerted on magnetic member 25 causes take-up member 21 to rotate following the pinion 19.

According to this invention, a pair of ribbon guides 28, 29, which extend upwardly through cassette holder 6 and are positioned in the path of a thermal ribbon 40 to be described in more detail later, are firmly secured to the end and midpoint of support arm 8 by means of connection members 30, 31, respectively. Two pairs of left and right spring guides 32, 33 are provided on the upper surface of cassette holder 6, with the respective guides 32, 33 having guide surfaces 32*a*, 33*a* inclined in predetermined directions.

Figure 4:
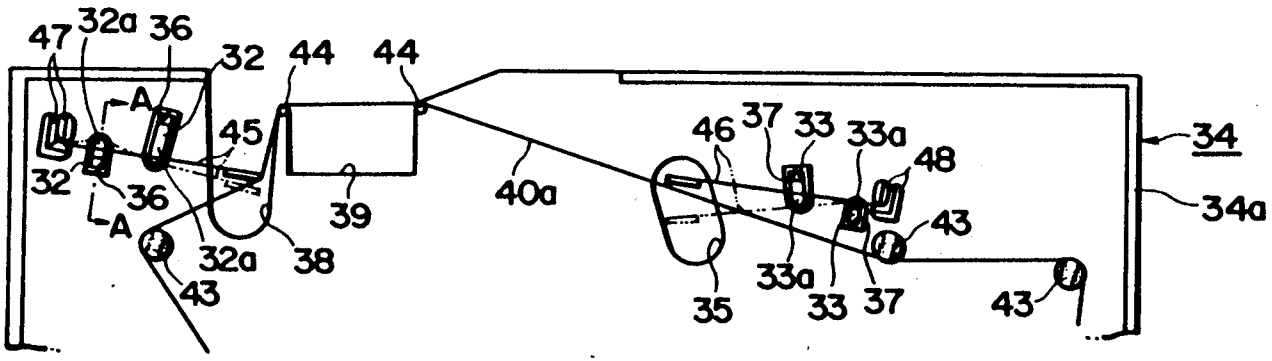
FIG. 4 is a fragmentary plane view showing the internal construction of the ribbon cassette.

Mounted removably on cassette holder 6 is a ribbon cassette 34 including a box-like body 34*a* and a plate-like cover 34*b*. As shown in FIG. 4, ribbon cassette 34 has apertures 35, 36, 37 that the right ribbon guide 29 and spring guides 32, 33 are allowed to enter, and openings 38, 39 that left ribbon guide 28 and printing head 29 are allowed to enter.

Housed rotatably within ribbon cassette 34 are a feed spool 41 around which an unused ribbon 40 is rolled and a take-up spool 42 which rolls used ribbon 40 therearound. When the ribbon cassette 34 is mounted on cassette holder 6, take-up spool 42 is engaged with spool engagement member 22 of take-up member 21. In order to guide ribbon 40 between spools 41 and 42 in cooperation with the respective ribbon guides 28, 29, three larger diameter guide pins 43 positioned in the vicinity of the respective spools 41, 42 and a pair of smaller diameter guide pins 44 positioned adjacent opening 39 are provided on the bottom of cassette body 34*a*.

According to this invention, a pair of leaf springs 45, 46 are secured at their bases by fixing members 47, 48 to press a moving portion 40*a* of ribbon 40 against ribbon guides 28, 29. Springs 45, 46 extend to opening 38 and aperture 35 and have end portions with a felt material adhering thereto. These leaf springs 45, 46 can selectively be disposed at their first positions shown by the solid lines in FIG. 4, their second position shown by the dot-dot-dashed lines in FIG. 4 and also shown by the solid lines in FIG. 1, and the third positions shown by the dot-dot-dashed lines in FIG. 1, respectively.

Figure 5A:
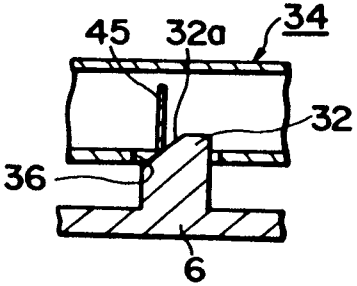
FIG. 5(*a*) is an enlarged cross-sectional view taken along the line A—A of FIG. 4, illustrating mounting the ribbon cassette.
Figure 5B:
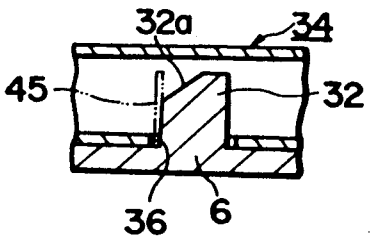

The operation of the printer constructed as described above will now be described. When ribbon cassette 34 is not mounted on cassette holder 6, the respective leaf springs 45, 46 are disposed at the first positions so as to oppose the spring guides 32, 33, respectively, on cassette holder 6, as shown by the solid lines in FIG. 4. Assume that printing head 9 is disposed at the release position shown by the solid line in FIGS. 1 and 2, and that ribbon guides 28, 29 are disposed at the rest positions shown by the solid lines in FIGS. 1 and 2. When ribbon cassette 34 is mounted on cassette holder 6 from above, printing head 9 is disposed within opening 39 forwardly from a moving portion 40*a* of ribbon 40, and the respective ribbon guides 28, 29 enter ribbon cassette 34 through opening 38 and aperture 35 to be disposed forwardly from the moving tape portion 40*a*. At the same time, as shown in FIGS. 5(*a*), (*b*), the spring guides 32, 33 enter ribbon cassette 34 through openings 36, 37, respectively, and their inclined guide surfaces 32*a*, 33*a* are engaged with leaf springs 45, 46, respectively. Thereafter, the respective leaf springs 45, 46 are displaced along the inclined guide surfaces 32*a*, 33*a* toward the second positions shown by the dot-dot-dashed lines in FIG. 4 (also shown by the solid lines in FIG. 1) while entering between the respective pairs of spring guides 32, 33. Thus, the springs 45, 46 are held at their middle portions between the respective sets of guides 32, 33 with the ends of springs 45, 46 abutting against ribbon guides 28, 29 from behind, thereby pressing the moving ribbon portion 40*a* against ribbon guides 28, 29. Therefore, an appropriate running resistance is imparted to the moving ribbon portion 40*a*.

In order to perform printing, when a release cam 12 is rotated by drive shaft 13 in the predetermined direction via worm 14 and helical gear 11 so that the smaller diameter portion 12*b* of cam 12 is placed opposed against cam follower 16, cam follower 16 is disengaged from release cam 12, and printing head 9 and ribbon guides 28, 29 are moved as a unit by the action of spring 17 via support lever 15 and support arm 8 to the print position and the operating position shown by the dot-dot-dashed line in FIG. 2. By this movement of ribbon guides 28, 29, the respective springs 45, 46 are displaced from the second position shown by the solid lines in FIG. 1 to the third positions shown by the dot-dot-dashed lines in FIG. 1.

The moving portion 40*a* of ribbon 40 between guides 28, 29 is then displaced toward platen 1 while being held between ribbon guides 28, 29, and the corresponding leaf springs 45 and 46, guided by print head 9 and pressed against a sheet of printing paper (not shown) on platen 1. Therefore, in this embodiment, the length of the ribbon portion 40*a*, namely, moving through the space between head 9 and platen 1 from the right ribbon guide 29 to the left ribbon guide 28, is maintained substantially constant during movement of printing head 9 from its release position to its printing position.

Under this condition, when carriage 3 is moved to the right and printing head 9 is operated, ink on thermo-transfer ribbon 40 is transferred to a sheet of printing paper to form a dot matrix character. Ribbon 40, pressed against the sheet of printing paper by printing head 9, is drawn out of feed spool 41 by the frictional force between ribbon 40 and the sheet of printing paper, pinion 19 is rotated counterclockwise in FIG. 2 by its engagement with rack 20, and the take-up member 21 is rotated following pinion 19 due to the magnetic force exerted from magnetic 24 on magnetic member 25. Take-up spool 42 is rotated as a unit with take-up member 21 with spool 42 being engaged with take-up member 21 through spool engagement member 22 thereof, so that used ribbon 40 is rolled up.

Generally, in a printer of the type in which the take-up spool is rotated at a constant speed each time one character is printed, irrespective of the diameter of the used ribbon rolled around the spool, a quantity of ribbon rolled each time a character is printed increases gradually as the diameter of the ribbon roll increases. In contrast, in the printer of this embodiment, as the quantity of rolled ribbon increases, namely, a load imposed on the take-up member 21 increases, a slippage produced between magnet 24 and magnetic member 25 increases, and take-up member 21 is decelerated in accordance with the load, so that a quantity of ribbon rolled each time one character is printed is maintained substantially constant irrespective of the changing diameter of the rolled ribbon.

When printing characters for one line is completed, release cam 12 is rotated through a predetermined angle by drive shaft 13, and the larger diameter cam portion **12*a* is engaged with cam follower 16, the printing head 9 and the respective ribbon guides 28 and 29 are returned as a unit from the print position and operating position shown by the dot-dot-dashed lines in FIG. 1 to the release position and rest positions shown by the solid lines in FIG. 1. Following the return of ribbon guides 28, 29, the leaf springs 45, 46 are returned by their resiliency from the third positions shown by the dot-dot-dashed lines in FIG. 1 to the second positions shown by the solid lines in FIG. 1. Thereafter, the moving ribbon portion 40*a* is held pressed against ribbon guides 28, 29**.

By the returning of head 9, pawl 27 is engaged with meshing member 23 to stop the rotation of take-up body 21, and moving ribbon portion **40*a* placed backwardly from the printing head is moved away from platen 1 to be engaged with smaller diameter guide pins 44 of ribbon cassette 34. Therefore, in this embodiment, the length of the ribbon portion 40*a* moving through between ribbon guides 28 and 29 is maintained substantially constant even during movement of printing head 9 from its printing position to its release position, so that no slackness is produced in the ribbon 40**.

When the printing head is disposed at its release position, the rotation of take-up spool 42 is stopped, so that when in this condition the carriage 3 is returned to the print starting position at the left end of the print line, a slippage will be produced between magnetic member 25 on pinion 19 and permanent magnet 24 on take-up member 21 even if pinion 19 may be rotated on the basis of its engagement with rack 20, and ribbon 40 will not be rewound from take-up spool 42 by the returning of carriage 3.

It is to be noted that this invention should not be limited to the previous embodiment. Any modifications could be made to the respective structural portions of the embodiments by those skilled in the art without departing from the spirit and gist of the invention defined in the claims. For example, the printing head may be an electrode through which a current flows and the print ribbon may be a transfer ribbon through which a current flows. A further example is that the drive means for printing head 9 and ribbon guides 28, 29 may be provided separately.

As described above in detail, this invention has the excellent advantages that the occurrence of slackness in the ribbon in the vicinity of the printing head is prevented, a stable movement of the ribbon is ensured, and defective printing is eliminated.

What is claimed is:

1. A printer with a ribbon guide mechanism comprising:

a carriage movable along a platen;

a printing head disposed on said carriage for movement relative to the carriage substantially perpendicular to a plane on which a sheet of paper would be supported for printing by said printer, said printing head being selectively movable at a print position proximal to said platen and at a release position spaced from said platen;

a ribbon cassette containing a print ribbon movable between said platen and said print head;

a pair of ribbon guides disposed on said carriage for movement relative to the carriage substantially perpendicular to said printing plane so as to be positioned in the path of said print ribbon, one being disposed on each of both sides of said printing head, each of said ribbon guides being selectively disposable at an operating position proximal said platen and a rest position spaced from said platen;

means for switching the position where said ribbon guides are disposed, such that the ribbon guides are disposed at said operating position when the printing head is at said print position at which the carriage is moved with said ribbon pressed against said platen and the ribbon guides are disposed in said rest position when the print head is in said release position with the ribbon spaced from the platen; and pressing means for maintaining a substantially constant length of a portion of said ribbon moving from one ribbon guide past the printing head to the other ribbon guide irrespective of the position of the ribbon guides, said pressing means being mounted on said ribbon cassette and having a pressing portion which follows the movement of said ribbon guides so that said ribbon is pressed at all times against said ribbon guides by said pressing means while said ribbon cassette is mounted on said carriage.

2. A printer of claim 1, wherein said pressing means includes a leaf spring fixed at one end to said ribbon cassette and pressed at the other free end against said ribbon guide.

3. A printer of claim 2, including a plurality of spring guides for said leaf springs, said spring guides being mounted alternately in a staggered manner on a cassette holder fixed to said carriage so that when said ribbon cassette is mounted on said cassette holder, said leaf springs receive alternately reverse transverse bending forces on their middle portions from said corresponding spring guides.

4. A printer of claim 1 wherein said switching means includes a cam follower means provided for movement together with the printing head energized toward the platen by a spring means, and a release cam means adapted to cooperate with said cam follower means to move the printing head away from the platen to a release position against the biasing force of the spring means.

5. A printer of claim 1, wherein said ribbon guides are disposed on a supporting means which supports said printing head thereon.

6. A printer with a ribbon guide mechanism comprising:

a carriage movable along a platen;

a printing head disposed on said carriage for movement relative to the carriage substantially perpendicular to a plane on which a sheet of paper would be supported for printing by said printer, said printing head being selectively movable between a print position proximal to said platen and a release position spaced from said platen;

a ribbon cassette containing a print ribbon moveable between said platen and said printing head;

ribbon holding means for holding a portion of said print ribbon at both sides of said printing head in a sandwiching manner and for maintaining said ribbon portion as a substantially constant length of said ribbon as said ribbon moves from one side of the printing head to the other side past the printing head irrespective of the position of said ribbon holding means, said ribbon holding means being movable relative to the carriage and substantially perpendicular to said printing plane so as to be positioned in the path of said print ribbon, wherein said ribbon holding means are selectively disposable at an operating position proximal said platen or at a rest position spaced from said platen; and means for switching the position where said ribbon holding means are disposed, such that the ribbon holding means are disposed at said operating position when the printing head is at said print position at which the carriage is moved with said ribbon pressed against said platen and the ribbon holding means are disposed in said rest position when the print head is in said release position with the ribbon spaced from the platen.

* * * * *